United States Patent [19]

Fogel et al.

[11] Patent Number: 4,597,120

[45] Date of Patent: Jul. 1, 1986

[54] WATERBED UTILIZING DUAL FLUID-FILLED MATTRESSES AND HAVING IMPROVED SURFACE CONTINUITY

[75] Inventors: Isaac Fogel, Silver Spring; Donald W. Keefer, Pasadena, both of Md.

[73] Assignee: Classic Corporation, Jessup, Md.

[21] Appl. No.: 714,069

[22] Filed: Mar. 21, 1985

Related U.S. Application Data

[63] Continuation of Ser. No. 500,823, Jun. 3, 1983, abandoned.

[51] Int. Cl.[4] ..... A47C 27/08

[52] U.S. Cl. ..... 5/451; 5/455

[58] Field of Search ..... 5/451, 455, 450, 449, 5/452, 470, 471, 513

[56] References Cited

U.S. PATENT DOCUMENTS

| | | | |
|---|---|---|---|
| 184,487 | 11/1876 | White | 5/451 |
| 779,576 | 1/1905 | Berryman | 5/455 |
| 1,356,148 | 10/1920 | Hobert | 5/470 |
| 2,159,910 | 4/1939 | Magaril | 5/470 |
| 2,859,455 | 11/1958 | Koenigsberg | 5/481 |
| 3,027,573 | 4/1962 | Bell | 5/470 |
| 3,732,585 | 5/1973 | Krehbiel | 5/451 |
| 3,736,604 | 6/1973 | Carson, Jr. | 5/451 |
| 4,181,990 | 1/1980 | Santo | 5/450 |
| 4,186,455 | 2/1980 | Fox, Jr. et al. | 5/451 |
| 4,187,566 | 2/1980 | Peterson | 5/474 |
| 4,221,013 | 9/1980 | Echevarria | 5/451 |
| 4,245,364 | 1/1981 | Calleance | 5/452 |
| 4,330,893 | 5/1982 | Matsui | 5/451 |
| 4,334,331 | 6/1982 | Santo | 5/452 |
| 4,371,998 | 2/1983 | Callaway | 5/451 |
| 4,449,261 | 5/1984 | Magnvsson | 5/470 |

FOREIGN PATENT DOCUMENTS

| | | | |
|---|---|---|---|
| 274162 | 10/1965 | Australia | 5/455 |

*Primary Examiner*—Alexander Grosz

*Attorney, Agent, or Firm*—Finnegan, Henderson, Farabow, Garrett & Dunner

[57] ABSTRACT

A waterbed comprising a pair of like fluid-filled mattresses arranged side-by-side; surface continuity means preferably being a covering around the bottoms and outward sides of the mattresses and a flexible sheet attached to the covering extending across the mattresses for maintaining the mattresses steadfastly in side-by-side relationship and for reducing the collapse of the abutting edges of the mattresses under load; and means attached to the surface continuity means for reducing motion transfer and heat transfer between the mattresses. In a preferred embodiment, the transfer reducing means is a partition separating the pair of mattresses and being attached on one side only to the bottom of the covering.

14 Claims, 7 Drawing Figures

WATERBED UTILIZING DUAL FLUID-FILLED MATTRESSES AND HAVING IMPROVED SURFACE CONTINUITY

This application is a continuation, of application Ser. No. 500,823, filed June 3, 1983, now abandoned.

BACKGROUND OF THE INVENTION

1. Field of the Invention

This invention relates generally to the field of waterbeds and more specifically to a waterbed utilizing a pair of like fluid-filled mattresses and having improved surface continuity between the mattresses and reduced motion transfer and heat transfer between the mattresses.

2. Description of the Prior Art

Beds utilizing fluid-filled mattresses, commonly referred to as waterbeds, have become quite useful and popular items in recent years. Due to various problems which tend to detract from the comfort and convenience that might otherwise be enjoyed by the use of a waterbed by two occupants on a single fluid-filled mattress, dual mattress waterbeds were created. Examples of dual mattress waterbeds are shown in U.S. Pat. No. 3,732,585, issued to Krehbiel; and U.S. Pat. No. 3,736,604, issued to Carson, Jr.

One benefit of using dual mattresses is that the individual mattresses can be filled to the degree of surface softness or firmness preferred by each of the individual bed users. However, the use of dual mattresses in a waterbed has heretofore encountered major deterrents.

On a conventional fluid-filled mattress, when a person lies or sits at the edge of mattress, the edge of the mattress will collapse to a great extent under load, i.e. under the body weight of the person. When two water mattresses are placed side-by-side in abutting relation to form a dual water mattress bed, this collapsing phenomenon is amplified by the presence of two mattress edges causing an unacceptable "drop-off" at the location where the two mattresses abut each other. This "drop-off" tendency reduces the surface continuity of the waterbed to an unacceptable degree effectively eliminating the usefulness of the dual mattress configuration in the center portion of the surface of the waterbed. Heretofore, as a person lying on the waterbed moves towards the center portion of the bed where the mattresses abut, the "drop-off" effect causes the mattress edge to dip which accelerates the person's gravitation to the center portion of the bed. Thus the occupant or occupants of the bed tend to settle in the valley formed in the dual mattress configuration where the mattresses abut.

Another deterrent to the use of a conventional dual mattress waterbed is the transfer of wave motion caused by a person's movement on one mattress from that mattress to the abutting mattress. Any movement by the first person is directly felt by a second person lying on the bed due to this wave movement transfer. An attempt to alleviate this particular problem is set forth in U.S. Pat. No. 3,732,585, issued to Krehbiel, in which is disclosed a bed with a supporting frame having two adjacent compartments for supporting and containing two separate fluid-filled mattresses positioned in a side-by-side relation. The mattresses are partially separated by a rib extending upward from the bottom of the supporting frame. The upstanding rib, however, only partially separates the two mattresses from one another thereby allowing wave motion transfer where the two water mattresses are in contact with each other along the center of the bed. Furthermore, the upstanding rib is an unyielding protrusion which is noticed by an occupant of the bed when contacted.

Since many waterbeds are provided with thermostatically controlled electrical heating elements to maintain the mattress fluid at a sufficient temperature to insure mattress surface warmth and comfort, a third disadvantage of the conventional dual mattress waterbed configuration exists. Since the conventional system allows the two fluid-filled mattresses to lie in contact with each other along the center of the bed and since water is an excellent conductor of heat, the individual temperature of each of the mattresses cannot independently be controlled. Heat transfer will take place between the two mattresses where they contact each other. Even if each mattress has an independent heater system, the dual mattress system will eventually reach the higher temperature setting of either of the two mattress heaters due to this heat transfer.

While the prior art dual water mattress systems provide many benefits, there are no dual mattress waterbeds which create and maintain surface continuity between the mattresses to reduce the unacceptable "drop-off" phenomenon, nor are there any dual mattress waterbeds which provide both means for reducing wave motion and heat transfer between the two mattresses.

From the foregoing considerations, it should be apparent that there is a great need for an improved bed utilizing dual fluid-filled mattresses.

It is, thus, an object of the present invention to improve surface continuity in a bed utilizing dual fluid-filled mattresses.

Another object of the invention is to reduce the "drop-off" phenomenon at the center area of a bed utilizing dual fluid-filled mattresses.

A further object of the invention is to reduce motion transfer between the mattresses of a bed utilizing dual fluid-filled mattresses.

Still another object of the invention is to reduce heat transfer between the mattresses of a bed utilizing dual fluid-filled mattresses.

Yet another object of the present invention is to reduce motion transfer and heat transfer between the mattresses of a bed utilizing dual fluid-filled mattresses without interfering with the surface continuity between the mattresses and without otherwise interfering with the comfort of the bed occupant or occupants.

Other objects and features of the present invention will become apparent hereinafter with reference to the accompanying drawings and detailed description of the invention.

SUMMARY OF THE INVENTION

To achieve the foregoing objects and in accordance with the purpose of the invention, as embodied and broadly described herein, a waterbed comprises a pair of like fluid-filled mattresses arranged side-by-side; surface continuity means at least partly transversely encircling the pair of mattresses for maintaining the mattresses steadfastly in side-by-side relationship and for reducing the collapse of the abutting edges of the mattresses under load; and means attached to the surface continuity means for reducing motion transfer and heat transfer between the mattresses. In a preferred embodiment, the surface continuity means comprises a covering around the bottom and outward sides of the mattresses and a flexible sheet attached to the covering extending across the mattresses, and the transfer reducing means comprises a partition separating the pair of mattresses and attached on one side to the bottom of the covering.

BRIEF DESCRIPTION OF THE DRAWINGS

The accompanying drawings, which are incorporated in and constitute a part of this specification, illustrate several embodiments of the invention and, together with description, serve to explain the principles of the invention.

Of the drawings.

DESCRIPTION OF THE PREFERRED EMBODIMENT

Reference will now be made in detail to the present preferred embodiments of the invention, examples of which are illustrated in the accompanying drawings.

Figure 1:
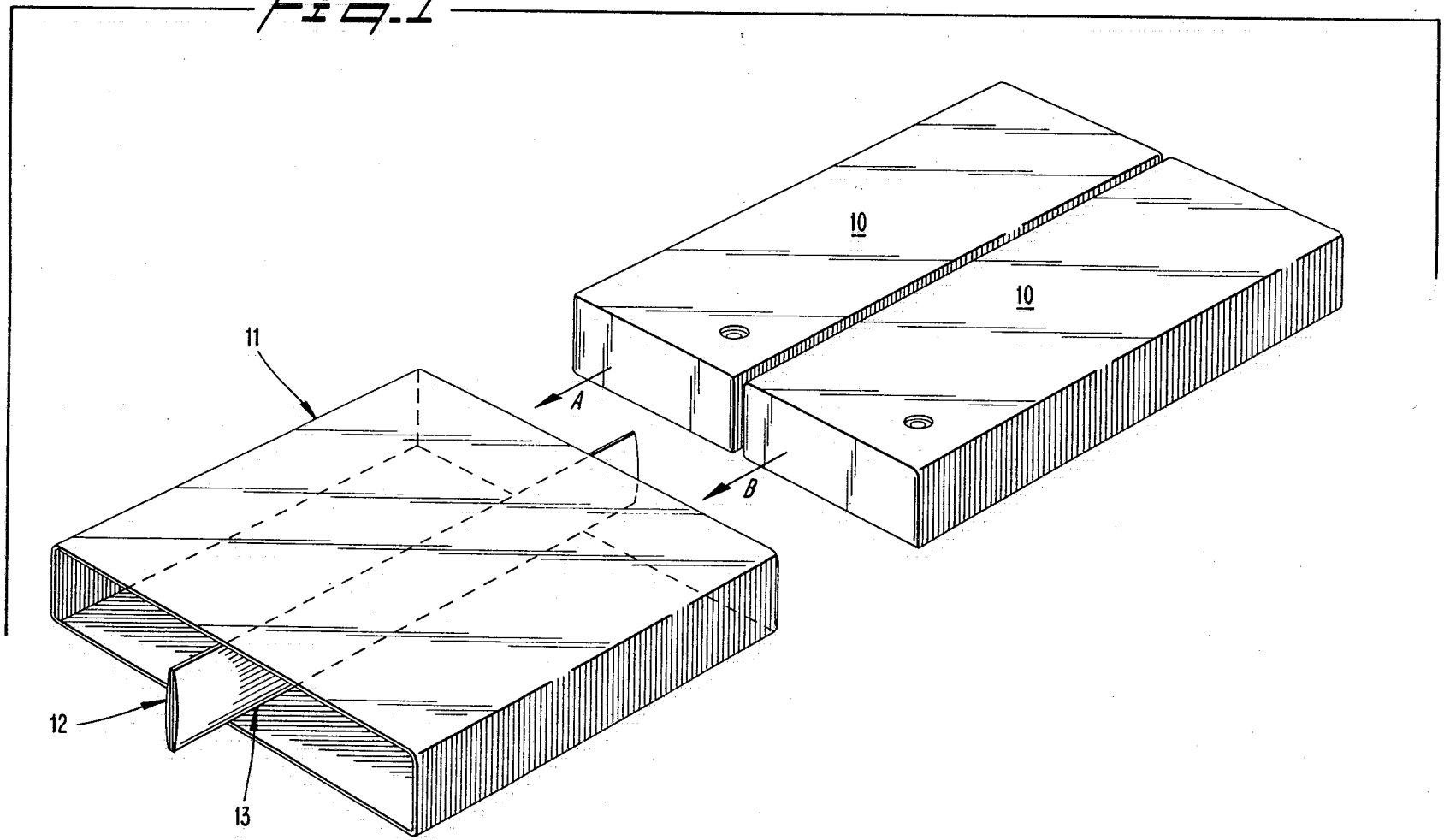
FIG. 1 is a perspective exploded view of the bed of the invention utilizing a flexible sleeve transversely encircling a pair of fluid-filled mattresses.

Referring now to the drawings wherein like reference characters designate like or corresponding parts throughout the several views, there is shown in FIG. 1 a waterbed comprising a pair of like fluid-filled mattresses 10 arranged side-by-side and, as surface continuity means, a flexible sleeve 11 transversely encircling the pair of mattresses for maintaining them steadfastly in side-by-side relationship and for reducing the collapse of the abutting edges of the mattresses under load.

The bed, in the preferred embodiment, further comprises means attached to the surface continuity means for reducing motion transfer and heat transfer between the mattresses. As embodied herein, the transfer reducing means is a partition 12 separating the pair of mattresses. To prevent partition 12 from working its way up between mattresses 10 or otherwise being displaced, the partition is attached along one side to the bottom portion of flexible sleeve 11 as shown at 13 in FIG. 1. Not being attached at its top, however, partition 12 does not interfere with the surface continuity between dual mattresses 10. The partition 12 can be attached by any conventional means, such as heat sealing, sewing, or adhesive bonding.

Partition 12 is at least as long as the length of the like mattresses 10 and is approximately the height of one of the mattresses. Being such, partition 12 precludes any contact between mattresses 10. The partition is made of soft material, such as one or more layers of one-quarter inch closed cell foam, which is capable of providing heat insulation and capable of reducing motion transfer between mattresses 10 without causing discomfort to the bed occupant or occupants. Partition 12 is covered in a cloth material or a plastic-type material such as vinyl.

In a preferred embodiment partition 12 is made of two sheets of one-quarter inch closed cell foam side-by-side. This arrangement provides the necessary barrier functions while also maintaining sufficient flexibility in the partition, particularly along its top, to make the partition unnoticeable to the bed occupant.

As illustrated in FIG. 1, flexible sleeve 11, which is made of a flexible, stretch-resistant material such as twelve mil vinyl, cloth, or the like, transversely encircles the pair of mattresses 10 such that the mattresses are held firmly in a side-by-side arrangement when the mattresses are filled with fluid in order to provide for and maintain surface continuity between the mattresses, particularly along the center line of the surface of the bed. Thus, collapse of the abutting surfaces of the mattresses under the body weight of an occupant of the bed is reduced. By doing so, the flexible sleeve reduces the unwanted "drop-off" effect.

Figure 2:
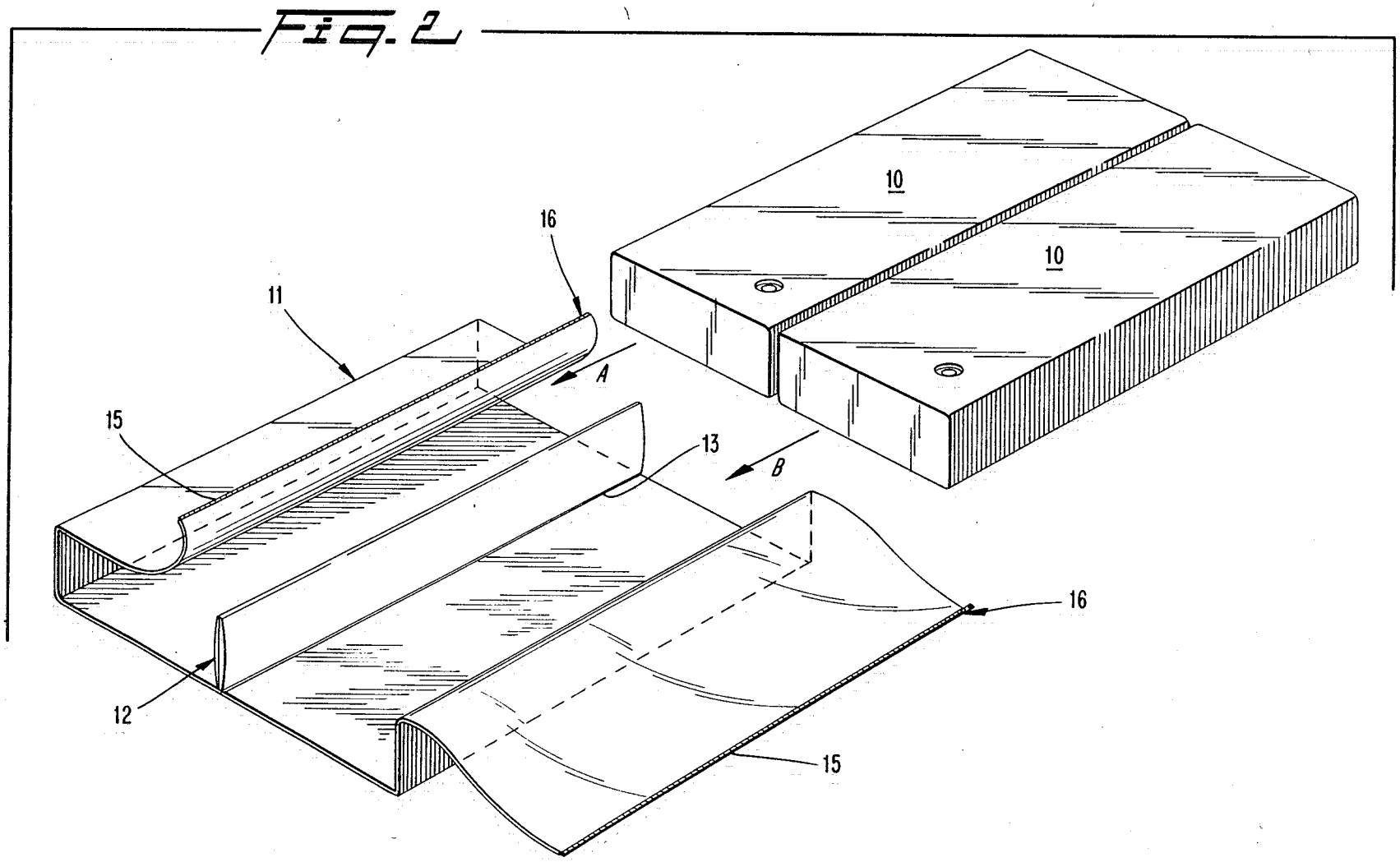
FIG. 2 is perspective exploded view of a modification of the bed shown in FIG. 1.

Flexible sleeve 11 can transversely encircle the entire length of mattresses 10 as shown in FIG. 2, or encircle somewhat less than the entire length of the mattresses as shown in FIG. 1 for example, where flexible sleeve 11 is approximately three quarters of the length of mattress 10. Preferably, the length of sleeve 11 should be no less than the distance between the shoulders and the knees of an average adult male. Furthermore, means can be provided, such as double-sided adhesive strips (not illustrated), to secure sleeve 11 to each mattress 10 in order to prevent movement of the mattresses with respect to the sleeve. Preferably, the adhesive strips are position to secure the bottoms of each mattress to the flexible sleeve.

As illustrated in FIG. 2, flexible sleeve 11 can be a sheet having opposing ends 15 containing connecting means 16, such as a zipper or the like, for connecting the two opposing ends to one another to form sleeve 11 for use in a manner like that shown in FIG. 1 and described above.

In operation, a pair of unfilled mattresses 10 are placed within flexible sleeve 11, which is manufactured to snugly hold a pair of fluid-filled mattresses 10. If sleeve 11 contains partition 12 then the mattresses are positioned as shown along arrows A and B of FIGS. 1 and 2 so that the partition will be between the abutting sides of the mattresses. After the unfilled mattresses 10 are positioned within sleeve 11, they are filled with fluid. Sleeve 11 holds the pair of fluid-filled mattresses 10 firmly in a side-by-side arrangement. The fluid pressure exerted from mattresses 10 on flexible sleeve 11 causes surface tension in sleeve 11 thereby providing and maintaining surface continuity between mattresses 10. When a person or persons are positioned on the water bed, the weight of the body or bodies causes water displacement in mattresses 10 which, in turn, provides additional tension on sleeve 11. In doing so, the "drop-off" phenomenon which normally occurs at the edges of the mattresses in the center of the bed is significantly reduced thereby providing a more comfortable and uniform sleeping surface.

Furthermore, in use, each mattress 10 may be heated with a conventional heating element to maintain the mattress fluid at a sufficient temperature to insure mattress surface warmth and comfort. Partition 12 reduces heat transfer between mattresses 10 so that the temperature of each mattress can be regulated to the personal preference of each user. Additionally, transfer of wave motion—caused by a person's movement on one mattress—from that mattress to the other mattress is reduced by the interference provided between the two mattresses by partition 12. The flexibility of partition 12 provides sufficient reduction in motion transfer and heat transfer between mattresses 10 without interfering with the provision and maintenance of surface continuity between the mattresses provided by flexible sleeve 11 and without interfering with the comfort of the occupant or occupants of the bed.

Figure 3:
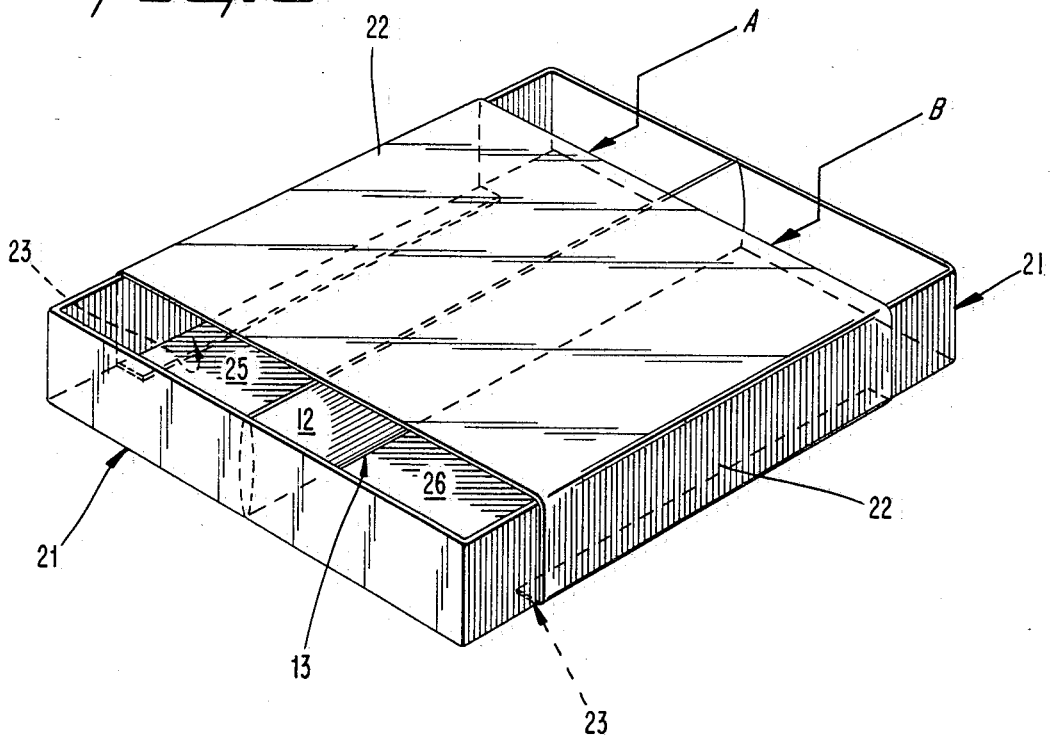
FIG. 3 is a perspective view of another embodiment of the bed utilizing a flexible sheet attached to a covering which may be a waterproof protective covering.

A modification of the surface continuity means for a pair of fluid-filled mattresses is shown in in FIG. 3. The waterbed comprises a pair of like fluid-filled mattresses 10 arranged side-by-side (which are not shown; however, one mattress 10 would be inserted along the line of arrow A into cavity 25, and the other along arrow B into cavity 26); surface continuity means having a covering 21 around the bottoms and outward sides of mattresses 10 and a flexible sheet 22 extending across the mattresses and attached to the covering, preferably along the locations 23 on the bottom of the covering; and partition 12. Flexible sheet 22 is attached to covering 21 by conventional means, such as heat sealing, sewing, or adhesive bonding.

Covering 21 may be a waterproof protective liner to act as a safety reservior for any fluid which should accidentally leak from one or both of mattresses 10.

As in the first embodiment, partition 12 is provided, if desired, for reducing motion transfer and heat transfer between mattresses 10 as shown in FIG. 3. Again, the partition is only attached on one side to the bottom of the surface continuity means. In the embodiment illustrated in FIGS. 3–5, the partition is attached to covering 21 along a line as shown at 13 in those figures. Preferably, partition 12 is not attached at either of its ends to covering 21.

Figure 4:
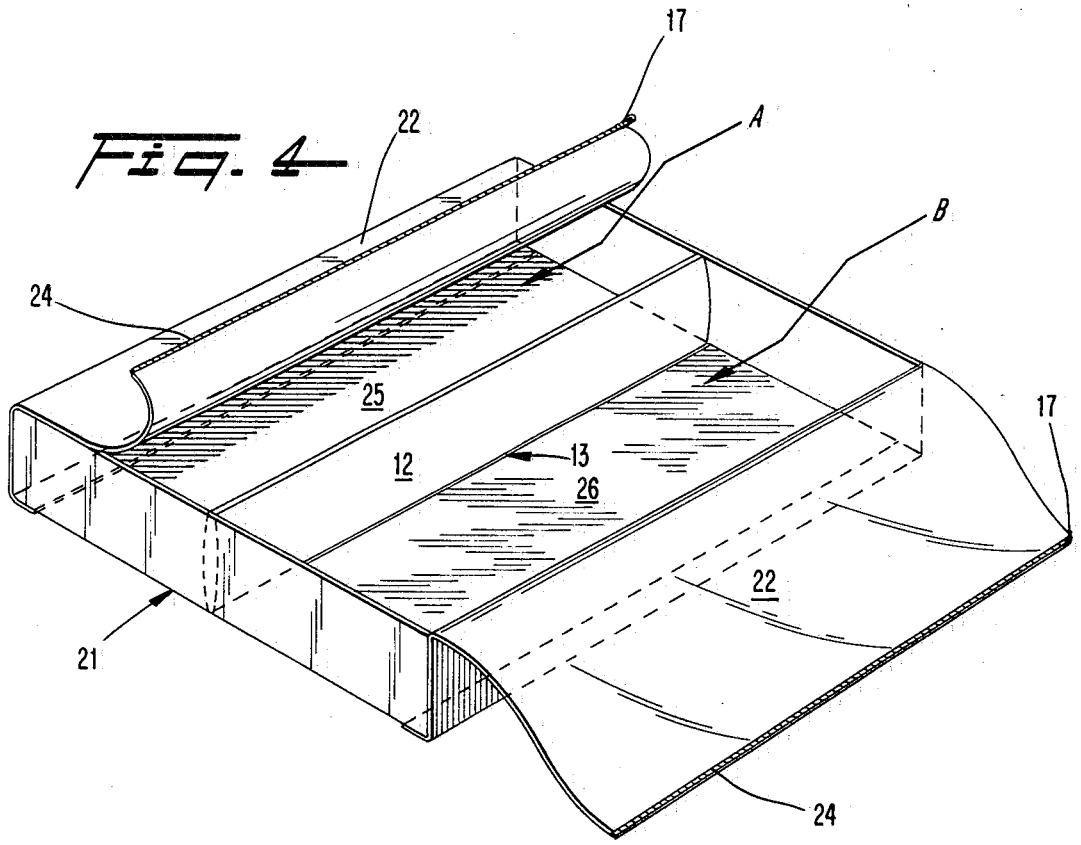
FIG. 4 is a perspective view of a further modification of the bed shown in FIG. 3.

Flexible sheet 22 can extend across the entire length of mattresses 10 as shown in FIG. 4, or extend across only a portion of the lengths of the mattresses as shown in FIG. 3. Furthermore, flexible sheet 22 can be provided with two opposing ends 24, each having connecting means 17, such as zippers or the like, as illustrated in FIG. 4, for connecting ends 24 together and for providing access to the mattresses when they are in position.

Figure 5:
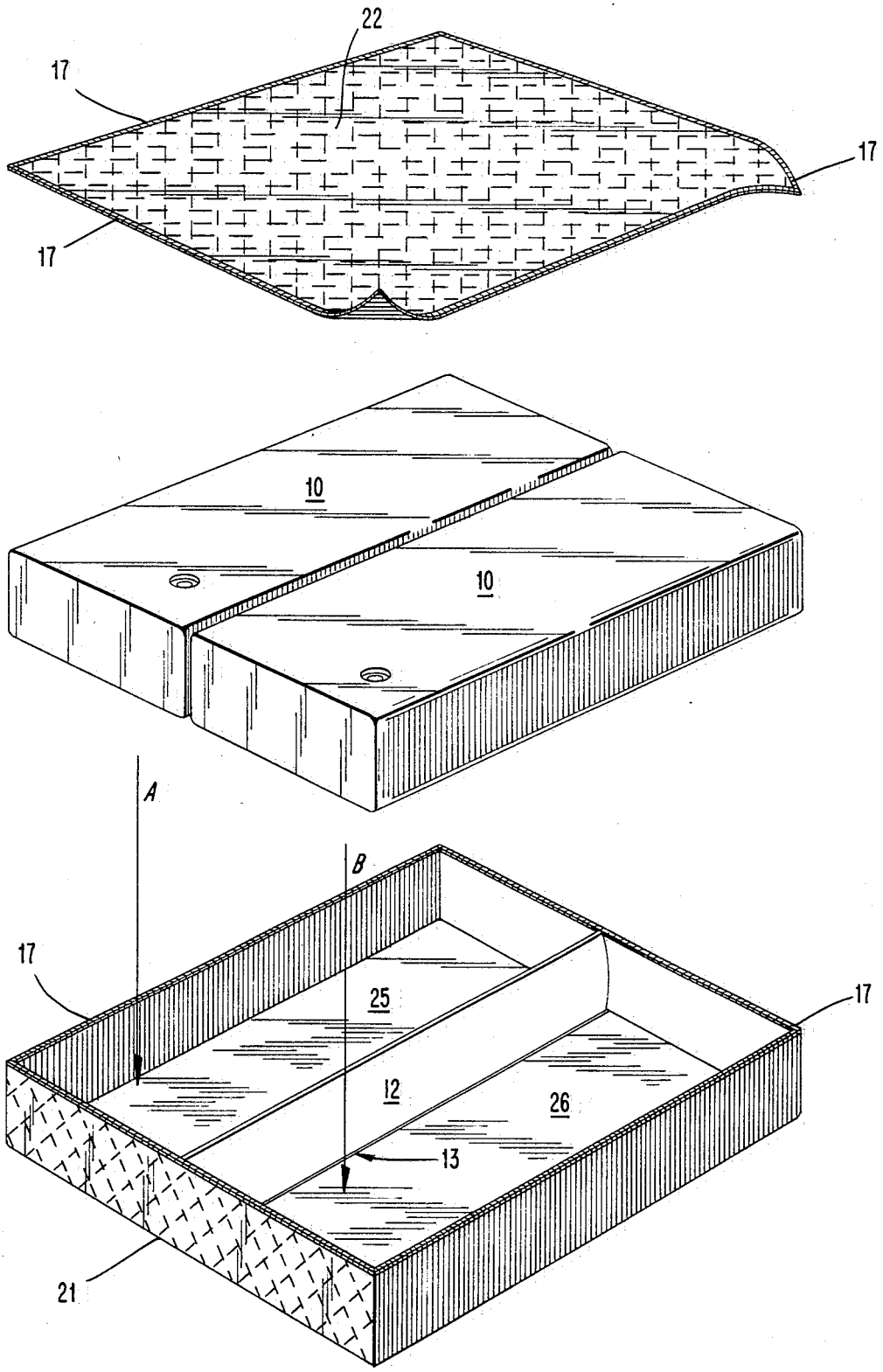
FIG. 5 is a perspective exploded view of another modification of the bed shown in FIG. 3.

In another modification flexible sheet 22 can have along its perimeter connecting means 17 for connecting the perimeter of sheet 22 to covering 21 as shown in FIG. 5. Again, the connecting means can be zippers 17 or the like.

Flexible sheet 22 may comprise an insulating felt or may include a quilted material on its exterior surface to serve as a mattress pad for the fluid-filled mattresses. In the embodiment illustrated in FIG. 5, wherein flexible sheet 22 is completely removable from cover 21, flexible sheet 22—acting as a mattress pad as well as surface continuity means—can be readily removed and laundered as necessary.

The operation of the embodiments illustrated in FIGS. 3–5 are similar to that in FIGS. 1 and 2 except that covering 21 is utilized in conjunction with flexible sheet 22 to provide and maintain surface continuity between mattresses 10.

Figure 6:
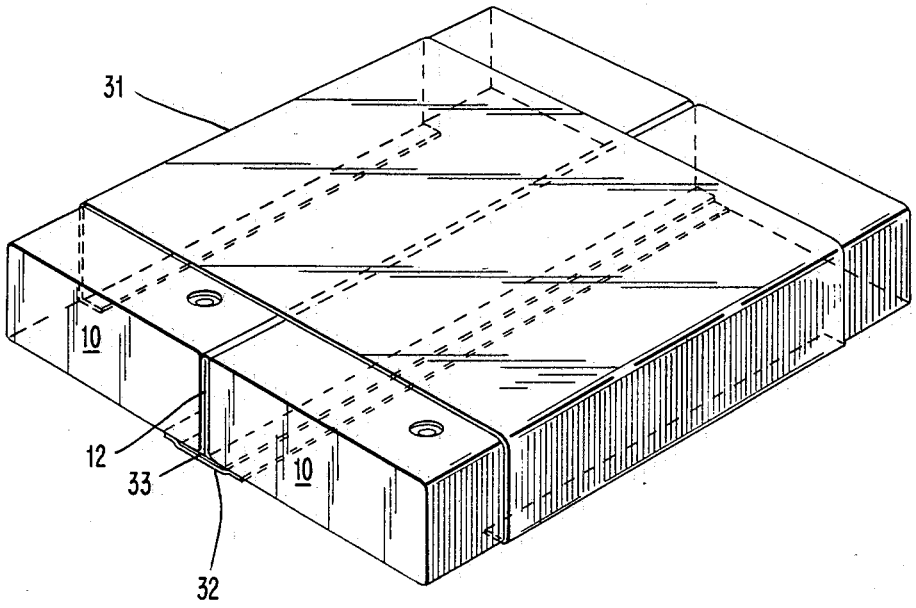
FIG. 6 is a perspective view of a third embodiment of the bed of the invention.
Figure 7:
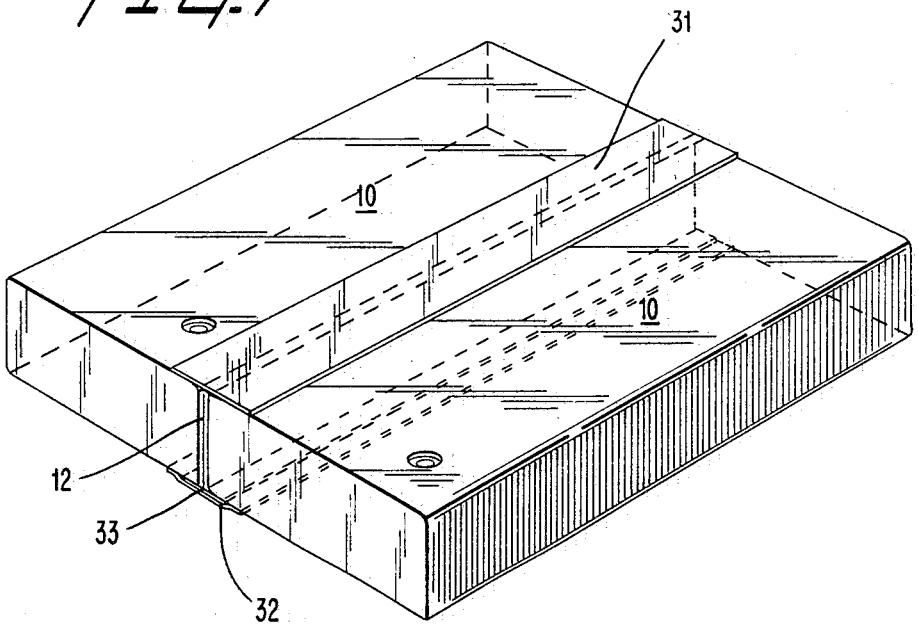
FIG. 7 is a perspective view of a modification of the bed illustrated in FIG. 6.

Shown in FIGS. 6 and 7, which illustrates another preferred embodiment, is a waterbed wherein the surface continuity means comprises a first flexible sheet 31 attached to mattresses 10 and extending across at least a portion of the top surface of each of the mattresses and a second flexible sheet 32 attached to the mattresses and extending across a portion of the bottom surface of the mattresses.

As shown in FIG. 6, flexible sheet 31 is attached to each mattress 10 along the undersides of both mattresses and extends over the top of the mattresses. The attachment again may be made by conventional means, such as heat sealing, adhesive bonding, or the like.

Partition 12 is attached by heat sealing, adhesive bonding, or the like on one side only to the bottom of each mattress 10 as shown at 33 in FIGS. 6 and 7, or to the second flexible sheet 32, or to both the mattresses and the second flexible sheet.

Additionally, as shown in FIG. 7, flexible sheet 31 in the form of a relatively narrow sheet can be attached to the top of each of mattresses 10.

The operation and use of the embodiment shown in FIGS. 6 and 7 is similar to that of the previously described embodiments.

Obviously many modifications and variations of the present invention are possible in light of the above teachings. It is, therefore, to be understood, that within the scope of the pending claims, the invention may be practiced otherwise than as specifically described.

What is claimed is:

1. A waterbed comprising:

a pair of like fluid-filled mattresses arranged side-by-side;

surface continuity means at least partly transversely encircling said pair of mattresses for maintaining said mattresses steadfastly in side-by-side relationship and for reducing the collapse of the abutting edges of said mattresses under load, said surface continuity means having a top wall above said mattresses and a bottom wall below said mattresses; and means attached to said surface continuity means for reducing motion transfer and heat transfer between said mattresses, wherein said transfer reducing means comprises a partition separating said pair of mattresses, said partition being attached only on one side to said bottom wall of said suface continuity means and being unattached and movable relative to said top wall of said surface continuity means.

2. The waterbed of claim 1 wherein said partition comprises two sheets of closed cell foam arranged side-by-side.

3. The waterbed of claim 1 wherein said surface continuity means comprises a flexible sleeve transversely encircling said pair of mattresses.

4. The waterbed of claim 3 wherein said flexible sleeve is a sheet having two opposing ends, said ends having means for connecting said ends together.

5. The waterbed of claim 1 wherein said surface continuity means comprises a covering around the bottoms and outward sides of said mattresses and a flexible sheet attached to said covering extending across said mattresses.

6. The waterbed of claim 5 wherein said covering is a waterproof protective liner.

7. The waterbed of claim 5 wherein said flexible sheet has two opposing ends, said ends having means for connecting said ends together.

8. The waterbed of claim 5 wherein the perimeter of said flexible sheet has means for connecting said perimeter to said covering.

9. The waterbed of claim 8 wherein said flexible sheet has a quilted material on its exterior surface to serve as a mattress pad for said fluid-filled mattresses.

10. The waterbed of claim 8 wherein said flexible sheet comprises an insulating felt.

11. The waterbed of claim 5 wherein said partition is attached on one side to the bottom of said covering.

12. The waterbed of claim 1 wherein said surface continuity means comprises a first flexible sheet attached to said mattresses and extending across at least a portion of the top surface of each of said mattresses and a second flexible sheet attached to said mattresses and extending across at least a portion of the bottom surface of said mattresses.

13. The waterbed of claim 12 wherein said partition is attached on one side to said second flexible sheet.

14. The waterbed of claim 13 wherein said partition is attached on said one side to said mattresses.

* * * * *